US006431357B1

(12) United States Patent
Su

(10) Patent No.: US 6,431,357 B1
(45) Date of Patent: Aug. 13, 2002

(54) ACCORDION-LIKE FILE HAVING DOCUMENT RETAINING STRUCTURE

(76) Inventor: Ken Jui Su, No. 180, Su Wang 1st Road, Da Li City, Taichung Hsien (TW), 412

( * ) Notice: Subject to any disclaimer, the term of this patent is extended or adjusted under 35 U.S.C. 154(b) by 0 days.

(21) Appl. No.: 09/867,507

(22) Filed: May 31, 2001

(51) Int. Cl.[7] ..... B65A 85/00
(52) U.S. Cl. ..... 206/425; 229/67.3
(58) Field of Search ..... 206/425; 229/67.1, 229/67.3, 67.4

(56) References Cited

U.S. PATENT DOCUMENTS 4,730,727 A * 3/1988 Petroff ..... 206/425
5,064,069 A * 11/1991 Su ..... 206/425
5,593,086 A 1/1997 Ho
5,630,509 A 5/1997 Su
5,664,724 A 9/1997 Ho
6,182,827 B1 * 2/2001 Su ..... 206/425

* cited by examiner

*Primary Examiner*—Bryon P. Gehman
(74) *Attorney, Agent, or Firm*—Charles E. Baxley

(57) ABSTRACT

An accordion-like file includes a bag having a base panel, two expandable connecting members disposed above the base panel for forming a gap between the bottom of the expandable connecting members and the base panel. One or more securing ears are attached to the bottom of the expandable connecting members, for detachably securing to the base panel and for blocking the gap formed between the bottom of the expandable connecting members and the base panel, and for solidly retaining the documents or the stationery goods within the bag.

5 Claims, 4 Drawing Sheets

ACCORDION-LIKE FILE HAVING DOCUMENT RETAINING STRUCTURE

BACKGROUND OF THE INVENTION

1. Field of the Invention

The present invention relates to a compartmentized file folder or an accordion-like file, and more particularly to an accordion-like file including a structure for stably holding and retaining documents within the accordion-like file.

2. Description of the Prior Art

Typical compartmentized file folders or accordion-like files comprise an openable or expandable bag body including one or more envelopes or compartments provided therein. Normally, a pair of expandable connecting members are secured on the sides of the envelopes. U.S. Pat. No. 5,593,086 to Ho, and U.S. Pat. No. 5,630,509 to Su, and U.S. Pat. No. 5,664,724 to Ho disclose three of the typical accordion-like files. The bottom portions of the expandable connecting members may not be secured to the bag body after the expandable connecting members are expanded or opened, such that the stationery goods may not be stably retained in the bag body and may be easily disengaged from the bag body from the bottom portion of the expandable connecting members.

The present invention has arisen to mitigate and/or obviate the afore-described disadvantages of the conventional accordion-like files.

SUMMARY OF THE INVENTION

The primary objective of the present invention is to provide an accordion-like file including a structure for stably holding and retaining documents and/or stationery goods within the accordion-like file.

In accordance with one aspect of the invention, there is provided an accordion-like file comprising a bag body including a base panel, two expandable connecting members provided above the base panel and each including a bottom portion, for forming a gap between the bottom portions of the expandable connecting members and the base panel, at least one securing ear attached to the bottom portion of the expandable connecting members, and means for detachably securing the securing ear to the base panel for blocking the gap formed between the bottom portions of the expandable connecting members and the base panel, and for solidly retaining the documents or the stationery goods within the bag body.

The expandable connecting members include two adjacent flaps, the securing ear includes two foldable members secured to the two adjacent flaps of the expandable connecting members.

The base panel includes a front portion and a rear portion, the bag body includes a front panel attached to the front portion of the base panel, and a rear panel attached to the rear portion of the base panel. The bag body may further include a number of envelopes secured between the two expandable connecting members.

The securing ear includes a free edge, the detachably securing means includes a securing strap secured to the free edge of the securing ear and the base panel.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
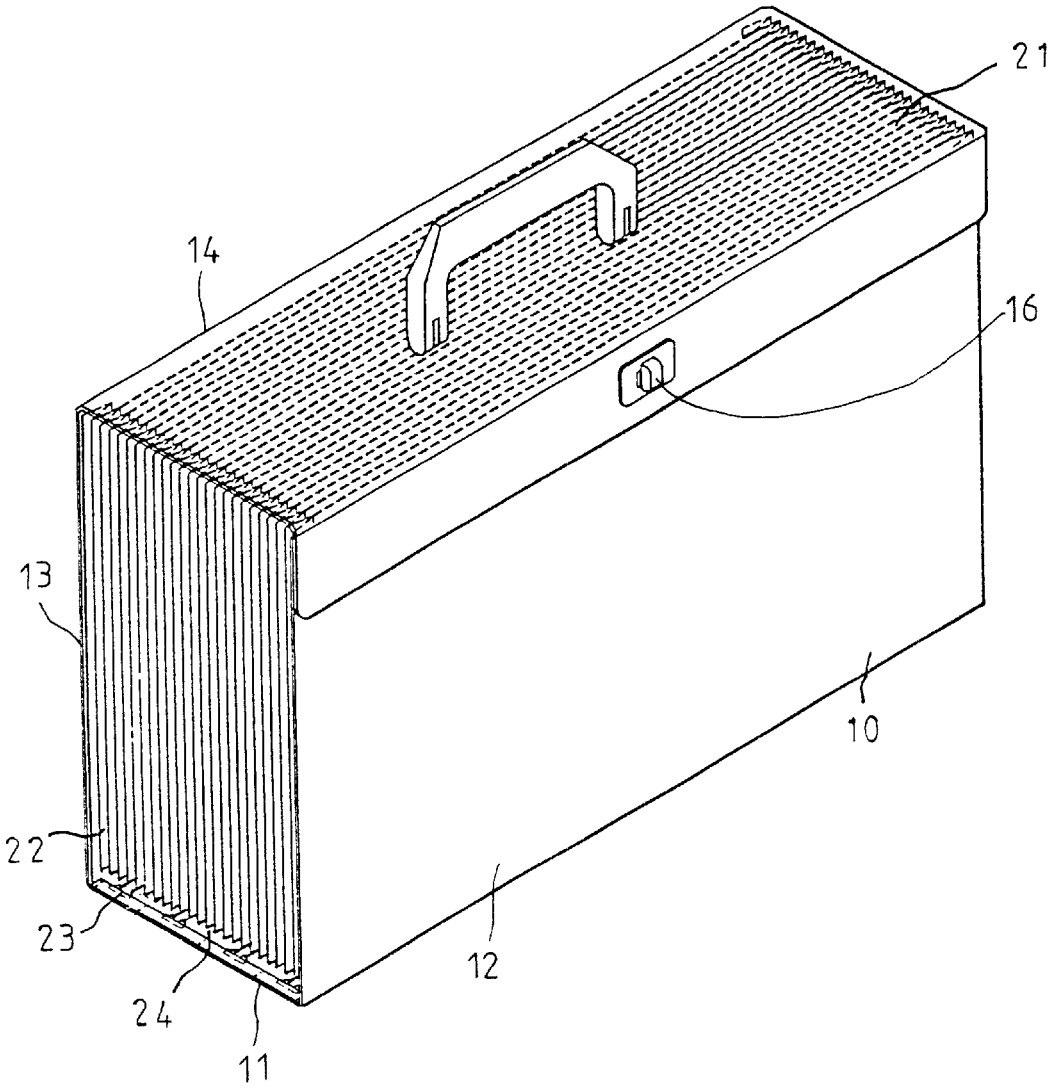
FIG. 1 is a perspective view of an accordion-like file in accordance with the present invention.
Figure 2:
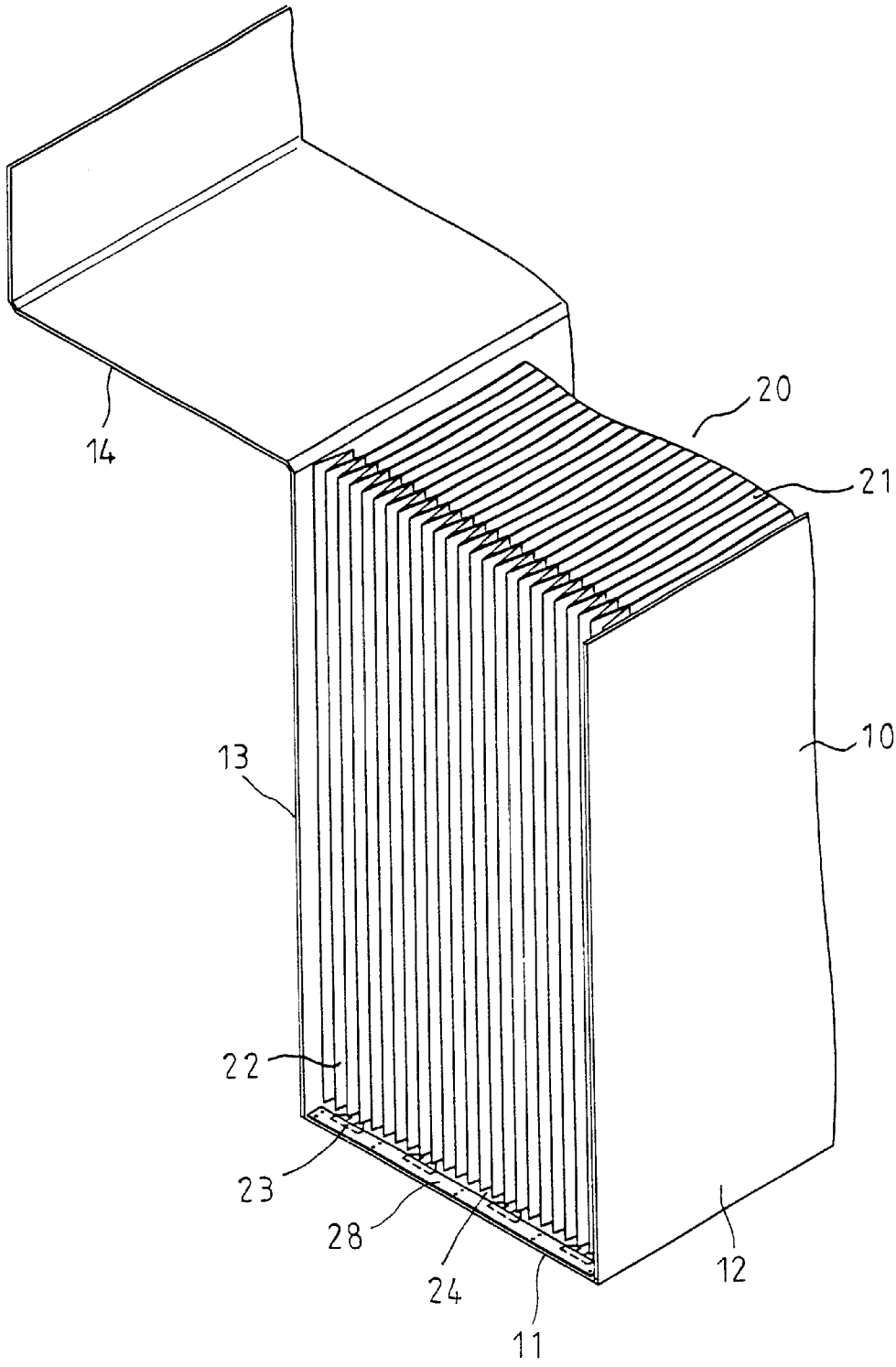
FIG. 2 is a partial perspective view of the accordion-like file, in which the cover has been opened.
Figure 3:
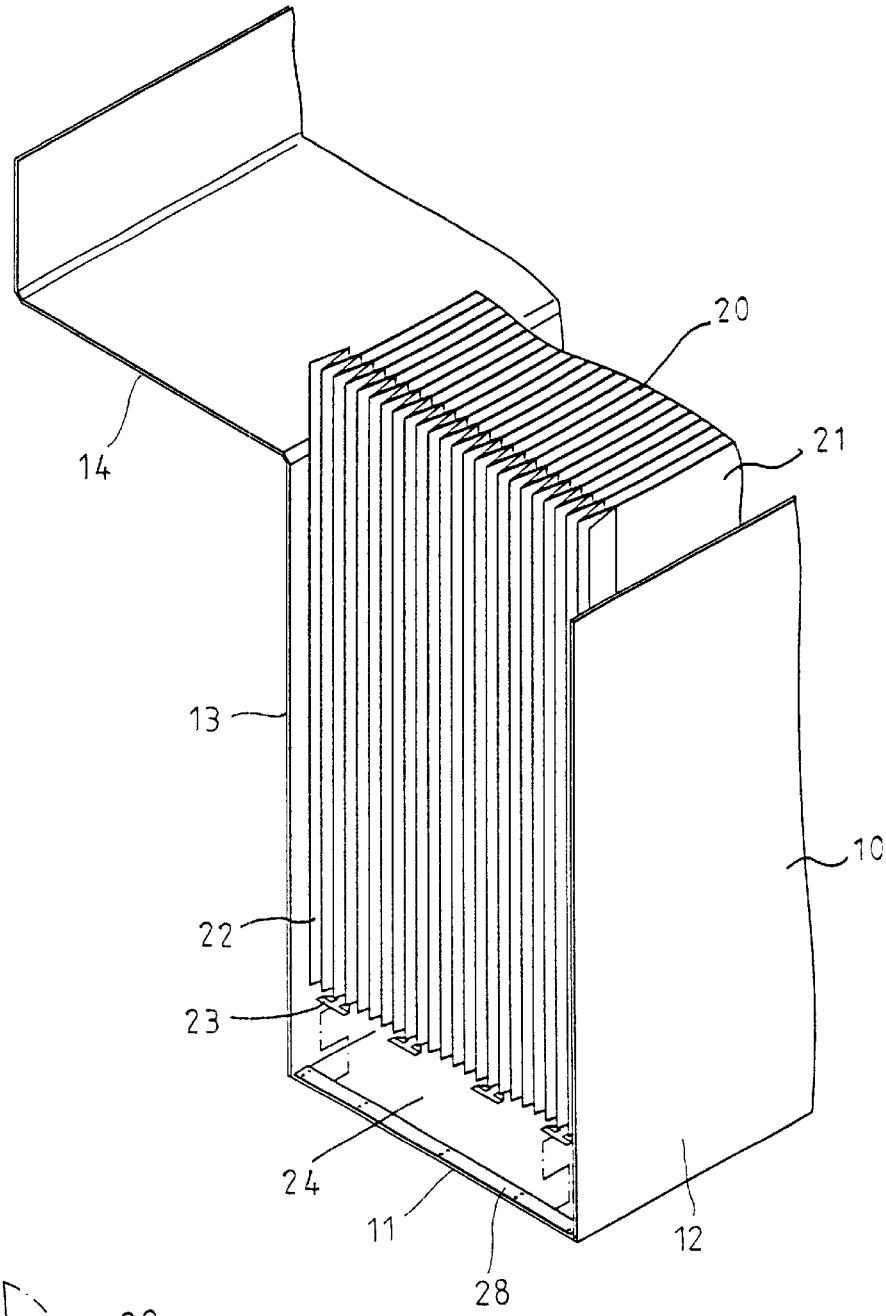
FIG. 3 is a partial perspective view similar to FIG. 2, in which the cover of the accordion-like file has been opened, and the compartments or the envelopes or the connecting members or the expanding members are separated from the outer casing of the file body.

Referring to the drawings, and initially to FIGS. 1–3, an accordion-like file in accordance with the present invention comprises a bag body 10 including a base panel 11, a front panel 12 coupled to the front portion of the base panel 11, a rear panel 13 coupled to the front portion of the base panel 11, and a cover panel 14 coupled to the upper portion of the rear panel 13, and lockable to the upper portion of the front panel 12 with a lock or latch device 16, for securing the bag body 10 in a parallelepiped configuration, as shown in FIG. 1. The base panel 11 preferable includes two half members that may be folded toward each other for allowing the front panel 12 and the rear panel 13 to be moved or folded toward each other to a compact configuration. The bag body 10 may be arranged in the expandable configuration as disclosed in U.S. Pat. No. 5,593,086 to Ho, and U.S. Pat. No. 5,630,509 to Su, and U.S. Pat. No. 5,664,724 to Ho, which are taken as a reference for the present invention.

A number of compartments 20 may be formed or provided within the bag body 10, such as formed between the front panel 12 and the rear panel 13, with one or more envelopes 21. Two expandable connecting members 22 are secured to the sides of the envelopes 21 and foldable to a compact folding configuration, and expandable to an expanded configuration or to an opened position (FIGS. 1–3). A gap 24 may be formed between the base panel 11 and the expandable connecting members 22, particularly when the expandable connecting members 22 are expanded to the opened position. The sides or the ends of the expandable connecting members 22 may be solidly secured to the front panel 12 and/or the rear panel 13 with adhesive materials or by welding processes, or may be detachably secured to the front panel 12 and/or the rear panel 13 with hook-and-loop devices or with fasteners or the like.

Figure 4:
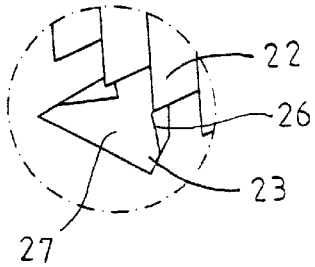
FIG. 4 is an enlarged partial perspective view of the accordion-like file.
Figure 5:
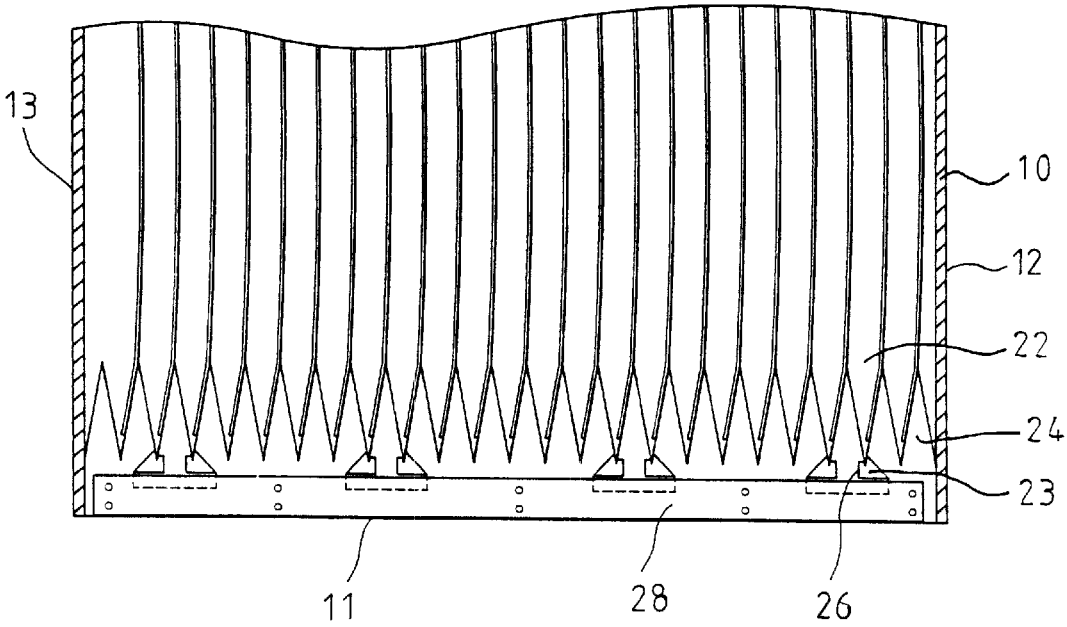
FIG. 5 is a partial end view of the accordion-like file.

The accordion-like file in accordance with the present invention further includes one or more securing ears 23 extended from the expandable connecting members 22. For example, as shown in FIG. 4, the securing ear 23 includes two foldable members 26 coupled to two adjacent flaps of the expandable connecting members 22, such that the securing ears 23 may also be folded or moved toward and away from the expandable connecting members 22. The securing ears 23 may be solidly secured to the base panel 11 with adhesive materials or by welding processes, or may be detachably secured to the base panel 11 with hook-and-loop devices or with fasteners or the like. As shown in FIGS. 2 and 5, it is preferable that the securing ears 23 are spaced away from each other for about five envelopes 21, for allowing the envelopes 21 and the expandable connecting members 22 to be folded and opened. The securing ears 23 each preferably includes a free edge 27 (FIG. 4) that may be solidly or detachably secured to the base panel 11 with an additional securing strap 28 or the like.

In operation, as shown in FIGS. 1, 2 and 5, when the securing ears 23 are secured to the base panel 11, the lower portion of the expandable connecting members 22 may be solidly secured to the base panel 11, for blocking a portion of the gap 24 that is formed between the base panel 11 and the expandable connecting members 22, particularly when the expandable connecting members 22 are expanded to the opened position. The documents or the stationery goods may thus be stably retained in the bag body 10 and will not be easily disengaged from the bag body 10 via the gap 24 that is formed between the base panel 11 and the expandable connecting members 22.

Accordingly, the accordion-like file in accordance with the present invention includes a structure for stably holding and retaining documents and/or stationery goods within the accordion-like file.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter, claimed.

I claim:

1. An accordion-like file comprising:

a bag body including a base panel, two expandable connecting members provided above said base panel and each including a bottom portion, for forming a gap between said bottom portions of said expandable connecting members and said base panel, at least one securing ear attached to said bottom portions of said expandable connecting members, and means for securing said at least one securing ear to said base panel for blocking said gap formed between said bottom portions of said expandable connecting members and said base panel.

2. An accordion-like file comprising:

a bag body including a base panel, two expandable connecting members provided above said base panel and each including a bottom portion, for forming a gap between said bottom portions of said expandable connecting members and said base panel, at least one securing ear attached to said bottom portions of said expandable connecting members, and means for detachably securing said at least one securing ear to said base panel for blocking said gap formed between said bottom portions of said expandable connecting members and said base panel.

3. The accordion-like file according to claim 2, herein said expandable connecting members include two adjacent flaps, said at least one securing ear includes two foldable members secured to said two adjacent flaps of said expandable connecting members.

4. The accordion-like file according to claim 2, wherein said base panel includes a front portion and a rear portion, said bag body includes a front panel attached to said front portion of said base panel, and a rear panel attached to said rear portion of said base panel.

5. The accordion-like file according to claim 2, wherein said at least one securing ear includes a free edge, said detachably securing means includes a securing strap secured to said free edge of said at least one securing ear and said base panel.

* * * * *